United States Patent [19]

Maier

[11] 3,933,290

[45] Jan. 20, 1976

[54] EXPLOSION-DRIVEN BOLT SETTING GUN WITH DRUM MAGAZINE

[75] Inventor: Elmar Maier, Feldkirch-Tisis, Austria

[73] Assignee: Hilti Aktiengesellschaft, Liechtenstein

[22] Filed: Aug. 29, 1974

[21] Appl. No.: 501,833

[30] Foreign Application Priority Data

Sept. 6, 1973 Germany ..... 2345054

[52] U.S. Cl. ..... 227/9

[51] Int. Cl.[2] ..... B25C 1/12

[58] Field of Search ..... 227/8, 9, 10, 11

[56] References Cited

UNITED STATES PATENTS

| | | | |
|---|---|---|---|
| 2,930,041 | 3/1960 | Massacrier | 227/11 |
| 3,048,850 | 8/1962 | Schilling | 227/11 |
| 3,095,572 | 7/1963 | Massacrier | 227/11 |

*Primary Examiner*—Granville Y. Custer, Jr.
*Attorney, Agent, or Firm*—Toren, McGeady and Stanger

[57] ABSTRACT

In a setting gun utilizing an explosive charge for driving fastening elements into a target material, a drum magazine holding both fastening elements and cartridges in receiving bores is rotatably mounted in a housing between a barrel and a breech plug. Separate spring biasing mechanisms hold the barrel and the drum magazine in a non-firing position. In moving the barrel and the drum magazine into the firing position it is necessary to overcome the spring biasing action and to displace both members opposite to the spring biasing direction.

7 Claims, 1 Drawing Figure

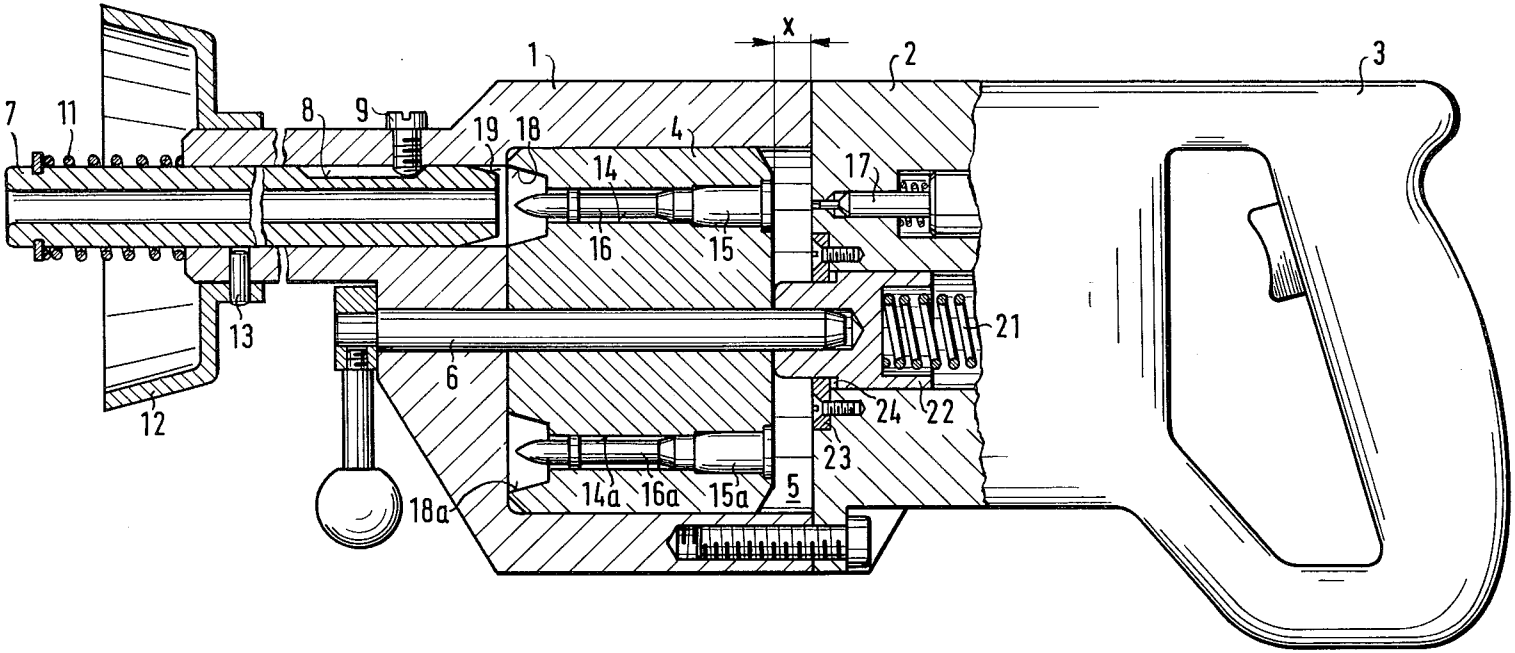
3
2
1
4
5
6
7
8
9
11
12
13
14
14a
15
15a
16
16a
17
18
18a
19
21
22
23
24
x

EXPLOSION-DRIVEN BOLT SETTING GUN WITH DRUM MAGAZINE

SUMMARY OF THE INVENTION

The invention is directed to a setting gun which utilizes an explosive charge for driving fastening elements into a target material and, more particularly, it concerns a barrel and a drum magazine each axially movable within a housing of the setting gun between a firing position and another position where the gun cannot be fired.

A prerequisite for the operation of setting guns of the type mentioned above which include a drum magazine for fastening elements and cartridges, is that the end face of the drum magazine in which the cartridge is positioned must bear against the breech plug at the time of firing. As a result, in known setting guns, the drum magazine is mounted with very little axial play in the gun housing and, in addition, it is held by spring force in contact with the breech plug. In such an arrangement one of the cartridges in the drum magazine is always located in the firing position. The operation of the firing mechanism in such setting guns is independent of the axial position of the drum magazine. If a cartridge is always in the firing position and the firing mechanism operates independently, there is a great risk that an accidental firing of a cartridge may occur either due to accidental actuation of the firing mechanism or actuation because of a malfunction.

To prevent any considerable power loss during the firing operation and to avoid excessive noise while insuring exact guidance of the fastening element, the drum magazine and the barrel must be in contact with one another with the axis of the barrel in alignment with the axis of the receiving bore containing the fastening element to be inserted. In conventional setting guns, the necessary contact is provided by having the adjacent end faces of the drum magazine and the barrel in a butt-joint arrangement. However, this arrangement does not provide satisfactory sealing and guiding properties, since a gap forms between the abutting surfaces if a slight fouling develops between the drum magazine and the barrel.

In other known setting guns, a barrel designed as an intermediate member, has been arranged between the drum magazine and a separate annular muzzle piece. The muzzle, in turn, is secured on a rod-shaped cocking slide mounted for axial movement in the gun housing. A compression spring positioned between the muzzle and the barrel keeps the barrel in constant contact with the front end of the drum magazine and while the gun is in the non-firing or rest position the muzzle is spaced an axial distance from the barrel.

The cocking slide has a guide nose projecting toward the center of the drum magazine and engages grooves on the magazine when the muzzle is displaced in the rearward direction. The engagement with the grooves insures alignment of the barrel bore with one of the receiving bores in the magazine.

In addition to the disadvantages of this arrangement because of its multiple element, it also has a number of operational drawbacks. For instance, the fastening element is not guided in the muzzle as it is driven into the target or receiving material and, as a result, there is a negative effect on the fastening quality. Furthermore, the mount of the muzzle on the cocking slide for displacement on the outer jacket of the housing is not suitable for apparatus which is exposed to rough construction site operation, since the dropping of the gun may result in deformation or damage to the cocking slide. If such damage occurs, the muzzle can no longer be pressed on and the gun will no longer fire. Similar troubles may also develop due to fouling and the resulting jamming of the cocking slide mechanism or the firing mechanism. In this type of gun it is easily possible that as it is lifted from the target material in the jammed and cocked state, a cartridge may be accidentally fired.

It is a primary object of the present invention to provide a setting gun which does not incorporate the abovementioned disadvantages and which cannot be fired unless the barrel of the gun is pressed against the target material.

In accordance with the present invention, when the barrel is pressed against the target material, the barrel and the drum magazine are displaced axially in the direction opposite to the firing direction into the firing position in which the drum magazine bears against the breech ring.

In the present invention the use of a separate muzzle piece with its elaborate and sensitive mount can be eliminated. If the barrel is not fully pressed against the receiving material so that it is in the firing position, a gap remains between the rear face of the drum magazine and the breech plug which prevents firing of the cartridge within the magazine. Moreover, the setting gun in accordance with the present invention affords exact guidance of the fastening member, since the barrel bears against the receiving material during the fastening operation.

Preferably, a force storage device is arranged between the drum magazine and the breech plug which displaces the drum magazine forwardly from the breech plug. As the force of the storage device is overcome when the barrel is pressed against the target material, the drum magazine moves rearwardly against the force storage device into contact with the breech plug. If the barrel is not pressed against the target material, the force storage device maintains the drum magazine in spaced relation from the breech plug, even in an unfavorable working position of the gun or in the case of vibrations. Preferably, the force storage device includes a compression spring. By properly dimensioning the compression spring, any increased friction of the drum magazine, as may be caused by fouling, can be easily overcome.

An exact and centered transmission of the spring force from the device to the drum magazine can be achieved if the device includes a pressure part designed as a bush which is aligned with the rotational axis of the magazine and is located between the compression spring and the magazine. Preferably, the pressure part is constructed so that its range of axial movement is limited whereby it extends into the space in the housing of the setting gun which contains the drum magazine only to a limited extent and does not hinder the replacement of the magazine. Another characterizing feature of the invention is the formation of a recess in the forward end of each receiving bore of the drum magazine so that it receives, in form fitting engagement, the rear portion of the barrel when the setting gun is arranged in the firing position. As a result of this construction, a form-closed connection is provided between the drum magazine and the barrel so that an effective seal is provided between the two.

The drum magazine is mounted for intermittent rotation within the setting gun so that each of its receiving bores containing a fastening element and a cartridge can be exactly aligned with the barrel axis by providing the recess in the forward end of each receiving bore with a frusto-conical shape widening in the driving direction. With the rearward end of the barrel having a corresponding frusto-conical shape proper alignment is provided as the barrel is displaced rearwardly into the forward end of a receiving bore in the drum magazine. With the present arrangement, special guide elements on the gun, such as noses, as well as elements on the magazine, such as slots, are not necessary for adjusting the exact magazine length.

To insure, on one hand, an effective seal at the point of juncture between the barrel and the drum magazine and, on the other hand, to provide a wider centering range for the barrel, the rear end of the barrel is preferably frusto-conically shaped to correspond to the similar shape within the recess in the adjacent end of the receiving bores in the drum magazine.

In addition to the spring loading action which biases the drum magazine in the driving direction, a separate spring loading device is provided between the barrel and the housing for spacing the barrel and the drum magazine when the setting gun is not in the firing position. This feature of the setting gun does not impair the rotatability or the assembly and disassembly of the drum magazine.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWING

The drawing is a side view, partly in section, of a setting gun embodying the present invention with the gun being in the non-firing or rest position.

DETAILED DESCRIPTION OF THE INVENTION

In the drawing a setting gun is illustrated which utilizes an explosive charge for driving fastening elements into a target or receiving material. The setting gun includes an axially extending housing 1 having a first end facing in the firing direction and a second end on which a breech plug 2 is secured. Rearwardly of the breech plug 2 is a handle 3 including a trigger mechanism for firing the setting gun. Just forwardly of the breech block 2 the housing 1 forms a receiving space 5 in which a drum magazine 4 is rotatably mounted on a movable shaft 6. As can be noted in the drawing, the axial dimension of the drum magazine 4 is less than the corresponding axial dimension of the space 5 so that the magazine can move in its axial direction within the space by a dimension x. On the opposite side of the drum magazine from the breech plug, a barrel 7 is located within the housing and extends outwardly from its first end. The barrel, like the drum magazine, is arranged within the housing for a limited amount of axial movement. The extent to which the barrel can move in the axial direction outwardly from the housing is limited by a groove 8 in the barrel into which a stop screw 9 mounted in the housing extends. On the forward end of the barrel extending from the first end of the housing, a spring 11 is helically wound around the barrel and extends between the first end of the housing and a ring member set in and extending outwardly from the barrel near its muzzle end. The spring biases the barrel forwardly from the space 5 within the housing so that it is maintained in spaced relationship from the drum magazine 4. A protective cap 12 is secured to the first end of the housing 1 by means of a pin 13 and extends forwardly from the housing and is located outwardly from the barrel 7. It can be noted that in the rest position of the setting gun shown in the drawing, the forward or muzzle end of the barrel is projected outwardly from the protective cap due to the biasing action of the spring 11.

The drum magazine has a plurality of receiving bores though only two such receiving bores 14, 14*a* are illustrated. Each of the receiving bores contains a cartridge 15, 15*a* and a fastening element 16, 16*a*. The receiving bore 14, as shown in the drawing, is aligned with the axis of firing pin 17 which is actuated by a firing mechanism of a known conventional type which is not represented. When the drum magazine is displaced into the firing position, the cartridge 15 contained in the rear of the receiving bore 14 is moved toward the breech plug 2 so that the firing pin 17 can ignite the cartridge.

For aligning the receiving bores in the drum magazine with the firing pin 17, known rotating means are used in association with the drum, and since such rotating means are known and do not form a part of the invention they have not been illustrated.

To seal the junction between the drum magazine 4 and the barrel 7 and to afford proper alignment of the receiving bores in the drum magazine with the axis of the barrel, a frusto-conical centering recess 18, 18*a* is provided at the forward end of each of the receiving bores in the magazine. Similarly, the rearward end of the barrel has a frusto-conical surface 19 corresponding to the centering recess 18 in the receiving bore so that a form fitting, seal-tight connection between the two can be provided when the barrel is displaced rearwardly into the firing position.

To insure that in any condition or position of the setting gun when it is not ready to fire a fastening element, that the drum magazine is maintained in spaced relationship from the breech plug 2 by the distance $x$, a force storage device consisting of a compression spring 21 is mounted within a recess in the breech plug 2 and biases a bush-type pressure part 22 into contact with the adjacent rearward face of the magazine drum 4. The pressure part 22 is aligned with the center or axis of rotation of the drum magazine so that the spring force is directed against the center of the magazine and canting of the magazine is prevented. Further, the pressure part is shaped so that the extent of its displacement into the receiving space 5 is limited by a stop 23 secured to the breech plug and a corresponding shoulder 24 formed on the pressure part.

As shown in the drawing, the setting gun is in the rest or non-firing position with a fastening element 16 located in the drum magazine 4 in position to be inserted into a target material. To place the gun in the firing position, the muzzle end of the barrel 7 is pressed against the target material and the pressing force initially displaces the barrel toward the second end of the housing against the biasing action of the spring 11. As the barrel moves rearwardly its frusto-conical surface 19 at its rearward end is moved into contact with the recess surfaces 18 in the receiving bore 14 of the drum magazine providing exact rotary positioning between the receiving bore 14 and the barrel 7. As the barrel is continuously pressed against the target material, it causes a rearward pressing action through the drum magazine 4 against the pressure part 22 which compresses the spring 21 until the magazine has moved through the distance *x* and come into contact with the adjacent face of the breech block. The cartridge 15 within the receiving bore 14 is now in the range of action of the firing pin 17 and the firing of the gun can be effectively carried out.

With the barrel pressing against the target material, the fastening element can be guided through the barrel into the material. At the completion of the insertion of the fastening element, as the setting gun is lifted from the target material, the compression spring 21 within the recess in the breech plug displaces the drum magazine 4 and the barrel 7 in the direction of the first end of the housing. When the magazine has been displaced through the distance *x* within the receiving space 5 its movement is stopped by the housing, however, the spring 11 on the forward end of the barrel continues to move the barrel forwardly so that it is displaced out of the recessed portion of the receiving bore with its forward end located outwardly from the leading edge of the protective cap 12. The separate biasing actions afforded by the compression spring 21 and the spring 11 about the barrel, return the movable parts of the setting gun to the rest position as shown in the drawing ready for another insertion operation. It can be appreciated, that with the completion of the firing operation, the receiving bore 14 is emptied and the next receiving bore containing a fastening element and cartridge is moved into position in alignment with the firing pin 17 and the barrel 7.

While a specific embodiment of the invention has been shown and described in detail to illustrate the application of the inventive principles, it will be understood that the invention may be embodied otherwise without departing from such principles.

I claim:

1. A setting gun utilizing an explosive charge for driving fastening elements, such as bolts, into a target material, comprising an axially extending housing having a first end facing in the direction in which fastening elements are driven and a second end spaced from the first end facing the opposite direction, a barrel axially movably mounted within said housing at the first end thereof, said barrel having a first end facing in the direction in which fastening elements are driven and a second end spaced from the first end thereof and facing in the opposite direction, said housing forming an axially extending space located intermediate the second end of said barrel and the second end of said housing, said space in said housing having a forward end and a rearward end spaced axially from the forward end and located further away from the first end of said housings, a rotatable drum magazine positioned within said space in said housing with its axis of rotation disposed in parallel relation with the axis of the housing and having a number of receiving bores therein each arranged to be aligned with the axis of the barrel, a breech plug located at the second end of said housing, and a firing mechanism located within said breech plug and arranged to fire cartridges positioned in the receiving bores in said drum, wherein the improvement comprises that said barrel and drum magazine are axially displaceable within said housing between a firing position and a rest position where the cartridges in said drum magazine cannot be fired, means axially displacing said barrel and said drum in the axial direction toward the first end of said housing into the rest position so that displacement of said barrel and drum magazine toward the second end of said housing against the action of said means is required for positioning said barrel and drum magazine in the firing position, said drum magazine having a forward end and a rearwad end spaced axially from the forward end and located closer to the second end of said housing, said means comprising a first means for spring biasing said barrel into the rest position and a second means for spring biasing said drum magazine into the rest position, in the rest position the forward end of said drum magazine is located spaced axially rearwardly from the second end of said barrel, said firing mechanism comprising a firing pin located entirely in said breech plug and arranged to fire a cartridge in said drum magazine when said drum magazine is moved into the firing position, said first means comprising a first spring biasing said barrel so that the second end of said barrel in the rest position is spaced axially forwardly of the forward end of said space containing said drum magazine, said second means comprises a force storage device mounted in said breech plug and disposed in contact with the rearward end of said drum magazine, said force storage device includes a compression spring for biasing said drum magazine toward the first end of said housing, said breech plug forms a closure at the second end of said housing extending across the end of the space in said housing containing said drum magazine and forming the rearward end of the space in said housing, said breech plug having a recess in the surface thereof forming the rearward end of the space in said housing and the recess being aligned with the axis of rotation of said drum magazine, said force storage device comprises a pressure part axially telescopically mounted in said recess for displacement in the axial direction of said housing and extending from said recess into contact with the rearward end of said drum magazine when said drum magazine is in the rest position, said compression spring located in said recess and disposed in contact with the opposite end of said pressure part from the end contacting said drum magazine for biasing the pressure part toward the first end of said housing and into contact with said drum magazine, and said pressure part being displaceable rearwardly into said pressure plug against the biasing action of said compression spring when said drum magazine is moved from the rest position to the firing position so that in the firing position the rearward end of said drum magazine contacts the surface of said breech plug forming the rearward end of the space within said housing containing said drum magazine.

2. A setting gun, as set forth in claim 1, wherein each said receiving bore has a forward end closer to the first end of said housing and a rearward end closer to the second end of said housing and the first end of each receiving bore has a recess centered about the axis of the receiving bore and shaped to receive in closely fitting engagement the end of said barrel located closer to the second end of said housing.

3. A setting gun, as set forth in claim 2, wherein said recess in said receiving bore is frusto-conically shaped with its surfaces diverging in the direction of the first end of said housing and the end of said barrel located closer to the second end of said housing having a similar frusto-conical shape.

4. A setting gun, as set forth in claim 1, wherein said first means includes a spring biasing said barrel outwardly from the first end of said housing.

5. A setting gun, as set forth in claim 4, wherein said barrel extends outwardly from the first end of said housing in the firing position as well as in the rest position, said spring encircling said barrel outwardly from the first end of said housing and bearing against the first end of said housing at one end and against said barrel at the other end.

6. A setting gun, as set forth in claim 1, wherein a shaft is supported in said housing and extends through the space in said housing in substantially parallel relation with the axis of said housing, said drum magazine rotatably supported on said shaft and the shaft extending into the recess in said breech plug with its end within said recess supported therein in said pressure part.

7. A setting gun, as set forth in claim 1, wherein a protective cap is secured to the first end of said housing and extends laterally from said housing and outwardly from the first end thereof so that it laterally encloses a portion of said barrel.

* * * * *